US007967355B2

(12) United States Patent
Lin et al.

(10) Patent No.: US 7,967,355 B2
(45) Date of Patent: Jun. 28, 2011

(54) VERTICAL TOOL STORAGE DEVICE WITH A CURVED HANDLE

(75) Inventors: Pei-Ying Lin, Taichung Hsien (TW); Chanwa Nguy, Cornelius, NC (US)

(73) Assignee: Steelworks Hardware, LLC, Taichung (TW)

( * ) Notice: Subject to any disclaimer, the term of this patent is extended or adjusted under 35 U.S.C. 154(b) by 264 days.

(21) Appl. No.: 10/554,757

(22) PCT Filed: Oct. 26, 2005

(86) PCT No.: PCT/US2005/039399

§ 371 (c)(1),
(2), (4) Date: Apr. 29, 2008

(87) PCT Pub. No.: WO2007/050088

PCT Pub. Date: May 3, 2007

(65) Prior Publication Data

US 2008/0197131 A1 Aug. 21, 2008

(51) Int. Cl.
*A47B 49/00* (2006.01)
*B65D 21/03* (2006.01)

(52) U.S. Cl. ..... 294/161; 206/372; 211/78; 211/70.6

(58) Field of Classification Search ..... 206/373, 206/349, 372, 821, 389, 407, 416; 220/475–481, 220/23.83, 23.86; 211/163, 71.01, 78, 95, 211/115, 131.1, 70.6; 312/246, 202, 125, 312/248; 248/131, 145; 294/161
See application file for complete search history.

(56) References Cited

U.S. PATENT DOCUMENTS

| | | | | | |
|---|---|---|---|---|---|
| 2,972,420 | A | * | 2/1961 | Tucci | 211/95 |
| 3,188,157 | A | * | 6/1965 | Rand | 312/202 |
| 3,498,471 | A | * | 3/1970 | Dirkx | 211/131.1 |
| 4,126,366 | A | * | 11/1978 | Handler et al. | 312/249.2 |
| 4,269,124 | A | * | 5/1981 | Rosenthal et al. | 108/103 |
| 4,279,366 | A | * | 7/1981 | Kessler et al. | 294/162 |
| 4,999,943 | A | * | 3/1991 | Crabtree | 43/54.1 |
| 5,383,556 | A | | 1/1995 | VanLoo | |
| 5,462,178 | A | * | 10/1995 | Wallach et al. | 211/95 |

(Continued)

FOREIGN PATENT DOCUMENTS

EP 1520729 4/2005

(Continued)

OTHER PUBLICATIONS

Supplementary Search Report for EP Patent Application No. 05824309 dated Feb. 24, 2009.

*Primary Examiner* — Steven A. Reynolds
(74) *Attorney, Agent, or Firm* — Levenfeld Pearlstein, LLC

(57) ABSTRACT

The tool storage device includes a base having a top side, a bottom side, and a hollow upright pivot shaft with two ends. At the top end of the hollow upright pivot shaft is an end cap having a plughole and a connecting mechanism. The bottom end of the hollow upright pivot shaft is attached to the top side of the base. The bottom side of the base has a pole cover containing a plughole for receiving a connecting structure. Fastening structures are provided to facilitate fastening of the vertical tool storage device to a structure, such as a wall. The end cap and the pole cover of the tool storage device enable the vertical tool storage device to be connected to a fastening and connecting structure.

27 Claims, 9 Drawing Sheets

U.S. PATENT DOCUMENTS

| | | | | |
|---|---|---|---|---|
| 5,830,083 | A | 11/1998 | Saint-Victor | |
| 5,971,169 | A * | 10/1999 | Orr et al. | 211/95 |
| 6,478,204 | B2 | 11/2002 | Lange | |
| D471,359 | S * | 3/2003 | Yang | D3/276 |
| 6,648,390 | B1 | 11/2003 | Yang | |
| 6,705,655 | B2 * | 3/2004 | Yang | 294/161 |
| 6,811,343 | B1 * | 11/2004 | Yang | 402/73 |
| D505,548 | S * | 5/2005 | Yang | D3/282 |
| D523,637 | S * | 6/2006 | Chang | D3/315 |
| 2003/0015446 | A1 * | 1/2003 | Talbot | 206/373 |
| 2005/0040062 | A1 * | 2/2005 | Chang | 206/373 |
| 2007/0102381 | A1 * | 5/2007 | Nguy et al. | 211/70.6 |
| 2008/0041799 | A1 * | 2/2008 | Nguy et al. | 211/70.6 |
| 2009/0020489 | A1 * | 1/2009 | Lin et al. | 211/88.01 |
| 2009/0114783 | A1 * | 5/2009 | Lin et al. | 248/200 |

FOREIGN PATENT DOCUMENTS

| | | |
|---|---|---|
| EP | 1547730 | 6/2005 |
| GB | 1008673 | 11/1965 |

* cited by examiner

VERTICAL TOOL STORAGE DEVICE WITH A CURVED HANDLE

FIELD OF THE INVENTION

The present invention relates to a tool storage device with a curved handle. The tool storage device with a curved handle comprises a base having a top side and a bottom side and a hollow upright pivot shaft having two ends, a top and a bottom end. At the top end of the hollow upright pivot shaft is connectably attached an end cap having a plughole; from the side of the end cap a partially curved handle is protruding. The bottom end of the hollow upright pivot shaft is attached to the top side of the base. The bottom side of the base has a pole cover containing a plughole for receiving a connecting structure. Fastening structures are optionally provided to facilitate the fastening of the vertical tool storage device with a curved handle to a structure, such as a wall. The end cap and the pole cover of the tool storage device enable the vertical tool storage device with a curved handle to be connected to a fastening and connecting structure.

BACKGROUND AND RELATED ART

A variety of tool cases and racks have been disclosed. The present invention provides a means for versatile tool storage. The present invention comprises a handle, a base, a hollow upright pivot shaft with a plurality of receptacles on trays attached through coupling rings, said receptacles sleeve the hollow upright pivot shaft. The combination of receptacles, trays, and coupling rings is referred to as a container device. Coupling rings are an integral part of the tray. The prior art has not contemplated the inventive tool storage device with a curved handle protruding from an end cap, which can be connected to a fastening and connecting structure for ready storage and connection to a support. As background, the following references are discussed:

U.S. Pat. No. 5,383,556 to Van Loo discloses a container for small objects that is provided with a glide closure.

U.S. Pat. No. 6,478,204 B2 to Lange, et al. discloses a receptacle having a translatably-guidable cover.

British Patent B 1008673 discusses a mandrel block 120, which includes a T-shaped projection 130, which conforms to the internal cross section of the connectors.

U.S. Pat. No. 5,830,083 to Saint-Victor shows a toy having a cross-fin portion and a female connector portion, the female connector portion having a set of diametrical, perpendicular grooves for receiving the cross-fin portion.

U.S. Pat. No. 6,648,390 B1 to Yang discloses a single-stack tool rack, which cannot be attached to the fastening and connecting structure disclosed here.

U.S. Pat. No. 6,811,343 B1 to Yang discloses a loose-leaf type storage device.

SUMMARY OF THE INVENTION

A novel means for flexible tool storage with a handle is provided. The vertical tool storage device can attach to a wall or other support or be carried to the work site. The container device is particularly adapted to hold wire nails and brads, flat and lock washers, metal screws and anchors, double end inset bits, drywall screws, and exterior screws.

The vertical tool storage device with a curved handle comprises a base having a top side and a bottom side, a hollow upright pivot shaft having two ends, a top end and a bottom end, one end cap and one pole cover. The pivot shaft is end capped with the end cap on the top end of the pivot shaft. A curved handle is protruding from the side of the end cap. The bottom of the hollow upright pivot shaft is attached to the top side of the base. The bottom side of the base is capped with a pole cover. A plurality of tool container trays is respectively pivoted to the hollow upright pivot shaft. The tool container trays comprise trays on which tool receptacle compartments are detachably supported. Each tray has a coupling ring protruding from the end of each tray proximal to the hollow upright pivot shaft. A tool receptacle positioning structure is provided in the coupling rings of the vertical tool storage device with a curved handle comprising a coupling ring sleeved onto said hollow upright pivot shaft.

An alternative embodiment of the vertical tool storage device with a curved handle enables the vertical tool storage device of this invention to be connected to a wall or other support. This embodiment comprises a base having a top side and a bottom side, a hollow upright pivot shaft having two ends, a top end and a bottom end, one end cap and a pole cover. The hollow upright pivot shaft is capped with the end cap on the top end of the shaft. A handle protrudes from the side of the end cap of the pivot shaft. The bottom end of the hollow upright pivot shaft is attached to the top side of the base. The bottom side of the base is capped with a pole cover. A plurality of tool containers are respectively pivoted to the hollow upright pivot shaft and arranged in a stack. The tool container trays each comprise a coupling ring respectively sleeved onto said hollow upright pivot shaft.

The end cap and pole cover have a coupling wall and a plughole formed in the coupling wall. Two detachable connecting structures for each tray have a plug rod and are attached to the end cap and to the pole cover. Two fastening structures comprising mounting bases have a plurality of apertures for fastening to a wall or other support. Each fastening structure comprises a coupling unit detachably connectable to the connecting structure. A tool container positioning structure is provided in the coupling rings of said tool container and the hollow upright pivot shaft for enabling said tool container to be horizontally positioned about said hollow upright pivot shaft and rotated or positioned in various angular positions.

DETAILED DESCRIPTION OF THE INVENTION

Figure 1:
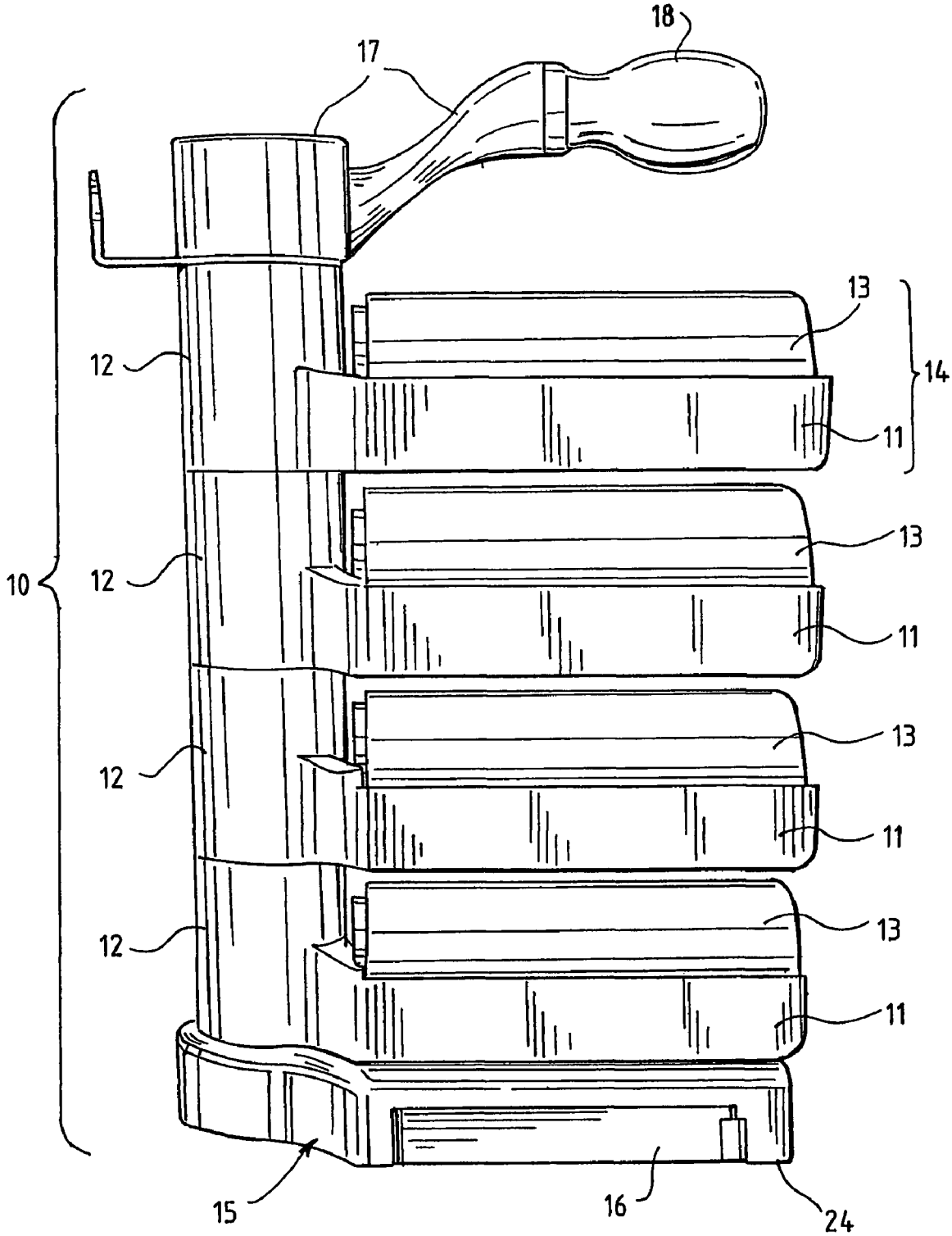
FIG. 1 illustrates the vertical tool storage device with the partially curved handle of this invention.

The present invention relates to a vertical tool storage device comprising a base having a top side and a bottom side, a hollow upright pivot shaft having two ends, a top end and a bottom end. An end cap is attached to the top end of the hollow upright pivot shaft. A partially curved handle protrudes from the side of the end cap.

The bottom end of the hollow upright pivot shaft attaches to the top side of the base. The bottom side of the base is end topped with a pole cover.

A plurality of tool containers are respectively pivoted to the hollow upright pivot shaft, and a tool container positioning structure is provided in the coupling rings of the tool container comprising a coupling ring respectively sleeved onto said hollow upright pivot shaft.

The curved handle of the vertical tool storage device protruding from the side of the end cap has a distal end, and a hand tool is coupled to the distal end of said partially curved handle. The curved handle is also strengthened by the addition of a rib. The vertical tool storage device optionally has on top of the end cap through the plughole attached a second end cap, which has a plughole on the top side.

The vertical tool storage device also comprises a tool container positioning structure; this structure comprises a plurality of longitudinal grooves spaced at equal angles around the periphery of the hollow upright pivot shaft, and a plurality of spring strips respectively are integrally formed with the coupling rings of the tool container. The spring strips each comprise a projection adapted for engaging the longitudinal grooves.

Each tool container comprises a receptacle, a tray, and a coupling ring attached to the tray body; the coupling rings of the tool container are respectively extended from one end of the tray and are proximal to the hollow upright pivot shaft. In one embodiment of this invention, the receptacle of each of the tool container is comprised of a bottom shell defining a plurality of compartments for keeping storage items, a top cover is hinged to one side of said bottom shell and is adapted for closing said compartments. A snap fastener is installed in the bottom shell and the top cover and both are adapted for locking said top cover when said top cover is closed on said bottom shell.

In one embodiment of this invention, the tray of each tool receptacle has an opening in one sidewall thereof corresponding to the snap fastener of the receptacle body of the respective tool container. The hand tool comprises a handle and a threaded shoulder disposed at the distal end of the handle of the hand tool and adapted for detachably holding a tool bit and threading into the hollow shank.

The base comprises a bottom open chamber and a swivel case mounted in the bottom open chamber further comprising a pivoting structure provided between the bottom open chamber of the base and the swivel case for enabling the swivel case to be turned in and out of the bottom open chamber, and a tool case positioning structure for enabling the swivel case to be positioned inside the bottom open chamber of the base. The pivoting structure comprises a downward pivot rod suspended inside the bottom open chamber of the base, and pivot aperture formed in one end of the swivel case and coupled to the downward pivot rod. The pivoting structure further comprises a fastening structure fastened to the downward pivot rod to secure the swivel case to the downward pivot rod and to let the swivel case be turned in and out of the bottom open chamber of the base about the pivot rod. The swivel case positioning structure comprises a first locating rib protruded from the periphery of the swivel case, and a second locating rib formed integrally with an inside wall of the base inside the bottom open chamber and adapted for stopping the first locating rib by friction resistance to hold the swivel case inside the bottom open chamber of the base. The swivel case comprises a plurality of clamps adapted for holding tool bits inside said swivel case.

In the vertical tool storage device of this invention, a plurality of tool containers are respectively pivoted to the hollow upright pivot shaft depending upon the size of the receptacle on the tray. Suitably, a plurality of tool containers preferably between four and eight tool container are respectively pivoted to the hollow upright pivot shaft. Eight tool containers are respectively pivoted to the hollow upright pivot shaft. Alternatively, four tool containers are pivoted to the hollow upright pivot shaft.

As an alternative embodiment, a vertical tool storage device is provided with a base having a top side and a bottom side; a hollow upright pivot shaft having two ends, a top end and a bottom end; an end cap attached to the top end of the hollow upright pivot shaft from the side of the end cap is protruding a partially curved handle. The bottom end of the hollow upright pivot shaft is attached to the top side of the base, and the bottom side of the base end is topped with a pole cover.

A plurality of the tool containers are respectively pivoted to the hollow upright pivot shaft and are arranged in a stack; each tool container comprises a receptacle, a tray having a coupling ring protruding from the side of the tray proximal to the hollow upright pivot shaft. The coupling ring is respectively sleeved onto said hollow upright pivot shaft. The coupling rings are part of the tray and are proximal to the hollow upright pivot shaft.

Both the end cap and the pole cover have a coupling wall and a plughole formed in the coupling wall. A detachable connecting structure device having a plug rod is attached to the end cap and the pole cover. Two fastening structures comprise a mounting base having a plurality of apertures for fastening to an upright support structure, each fastening structure comprises a coupling unit detachably connected to the two connecting structures.

A tool container positioning structure is provided in the coupling rings of the tool container and the hollow upright pivot shaft for enabling the tool container to be horizontally turned about the hollow upright pivot shaft and positioned in one of a series of angular positions.

The handle of the vertical tool storage device protruding from the side of the end cap has a distal end and a hand tool coupled to the distal end of the handle. The handle is also strengthened by the addition of a rib.

The vertical tool storage device further comprises a tool container positioning structure, the tool container positioning structure comprising a plurality of longitudinal grooves spaced at equal angles around the periphery of said hollow upright pivot shaft, and a plurality of spring strips respectively formed integral with the coupling rings of said tool container, said spring strips each comprising a projection adapted for engaging said longitudinal grooves. Each tool container comprises a tray and a receptacle body carried in the tray; the coupling rings of the tool container are respectively extended from the tray.

Optionally, the receptacle body of each of the tool receptacle is comprised of a bottom shell defining a plurality of compartments for keeping storage items, a top cover hinged to one side of said bottom shell and adapted for closing said compartments, and a snap fastener installed in said bottom shell and said top cover and adapted for locking said top cover when said top cover is closed on said bottom shell.

Optionally, the tray of each tool container has an opening in one side wall thereof corresponding to the snap fastener of the receptacle body of the respective tool receptacle. The hand tool comprises a handle and a threaded shoulder disposed at one end of the handle of said hand tool and adapted for detachably holding a tool bit and threading into the hollow shank. The base of the tool storage device comprises a bottom open chamber and a swivel case mounted in said bottom open chamber. The tool storage device further comprises a pivoting structure provided between said bottom open chamber of said base and said swivel case for enabling said swivel case to be turned in and out of said bottom open chamber, and a tool case positioning structure for enabling said swivel case to be positioned inside said bottom open chamber of said base.

DETAILED DESCRIPTION OF THE EMBODIMENTS

FIG. 1 illustrates the vertical stool storage device (10) of this invention including a handle (18). The figure shows the curved end cap (17), handle (18), receptacle (13), tray (11), and container (14), which is a combination of tray (11), receptacle (13), and coupling rings (12). A swivel case (16) is mounted in the bottom open chamber of the base (15), more particularly at the bottom of the base (24).

Figure 2:
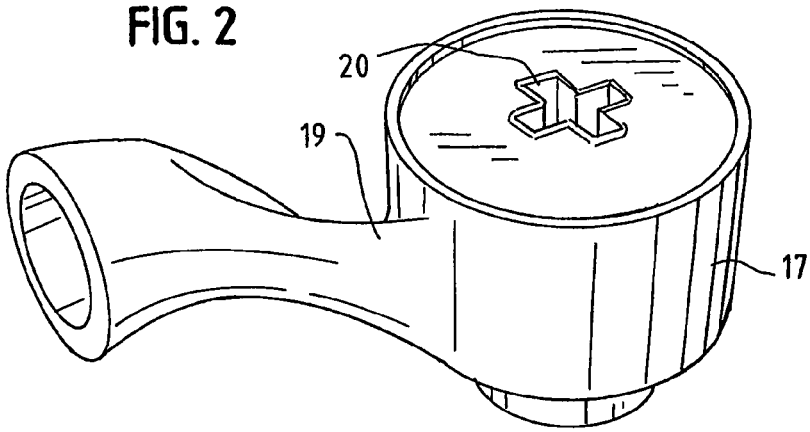
FIG. 2 illustrates the curved end cap, having a rib to strengthen the partially curved handle. A plughole is also illustrated, which enables the user to attach connecting and fastening structure of the vertical tool storage device to connect to a wall or other support.

FIG. 2 illustrates the end cap with the curved protrusion from the side (17). The curved handle shows a rib (19) to strengthen the handle. A plughole (20) also is illustrated. Optionally through the plughole (20), a plug rod (35) of a connecting structure (33) and fastening structure (34) is attached to the end cap (17), so the vertical tool storage device (10) can be attached to a wall or other structure.

Figure 3A:
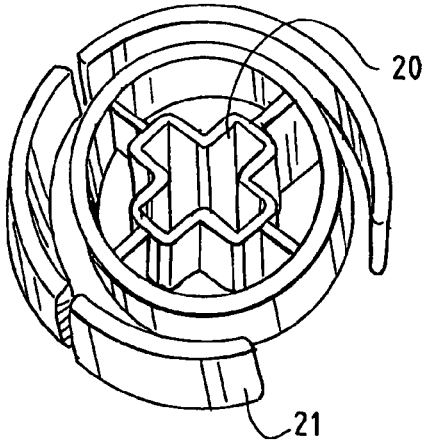
FIGS. 3A and 3B illustrate the top and bottom view of the pole cover. The plughole enables a plug rod of a connecting and fastening structure to be attached to the pole cover enabling the vertical tool storage device to be fastened to a wall or other support.
Figure 3B:
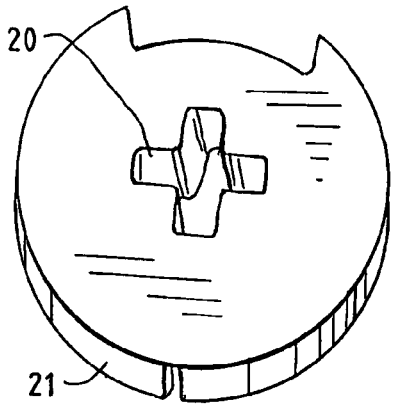

FIGS. 3A and 3B illustrate the pole cover (21) top and bottom view. Optionally, through the plughole (20), a plug rod (35) of a connecting structure (33) and fastening structure (34) is attached to the pole cover (21), so the vertical tool storage device (10) can be conveniently hanged on a wall.

Figure 4:
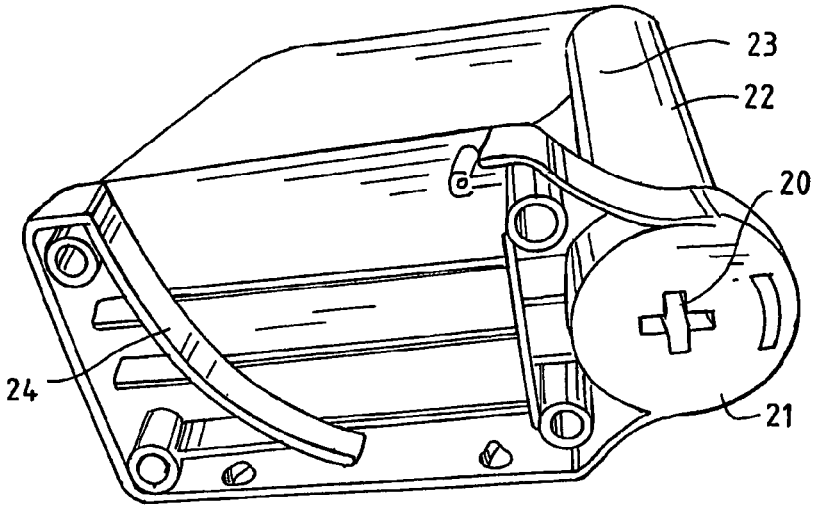
FIG. 4 illustrates the bottom of the base of the vertical tool storage device.

FIG. 4 illustrates the bottom of the base (24) showing the pole cover (21), plughole (20), hollow upright pivot shaft (22), and one of three equidistant grooves (23) on the hollow upright pivot shaft (22).

Figure 5:
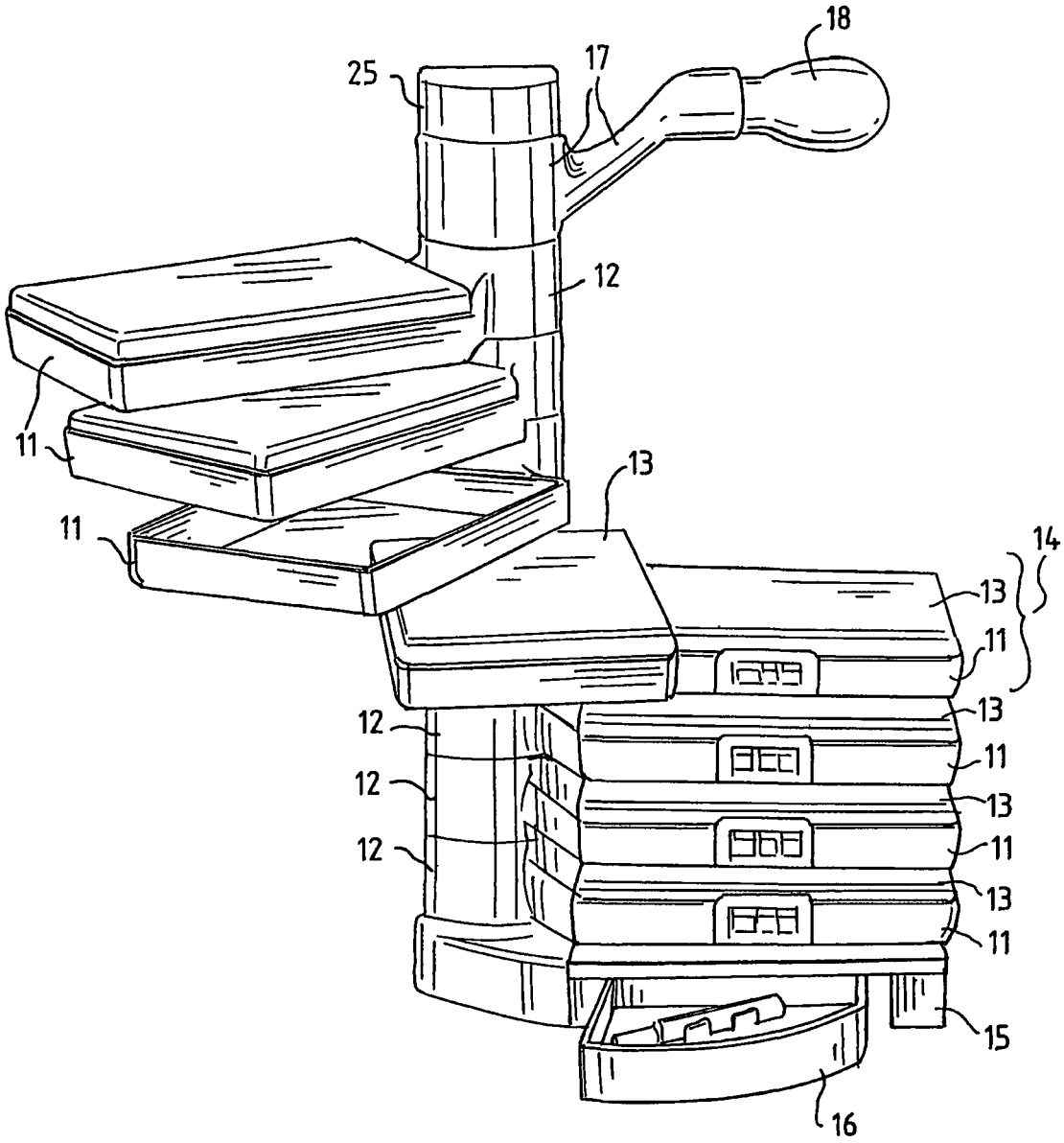
FIG. 5 illustrates an alternative embodiment of the vertical tool storage device having an optional cap on top of the end cap from which the partially curved handle is protruding.

FIG. 5 illustrates the vertical tool storage device (10) of this invention with an optional cap (99) over the top of the end cap (17) with the curved protrusion from the side. The receptacle (13), tray (11), and container (14), which is a combination of tray (11), receptacle (13) and coupling rings (12). Eight trays (11) are attached to the hollow upright pivot shaft (22). One tray (11) does not have a receptacle (13). A swivel case (16) in the open position is mounted in the bottom open chamber of the base (15).

Figure 6:
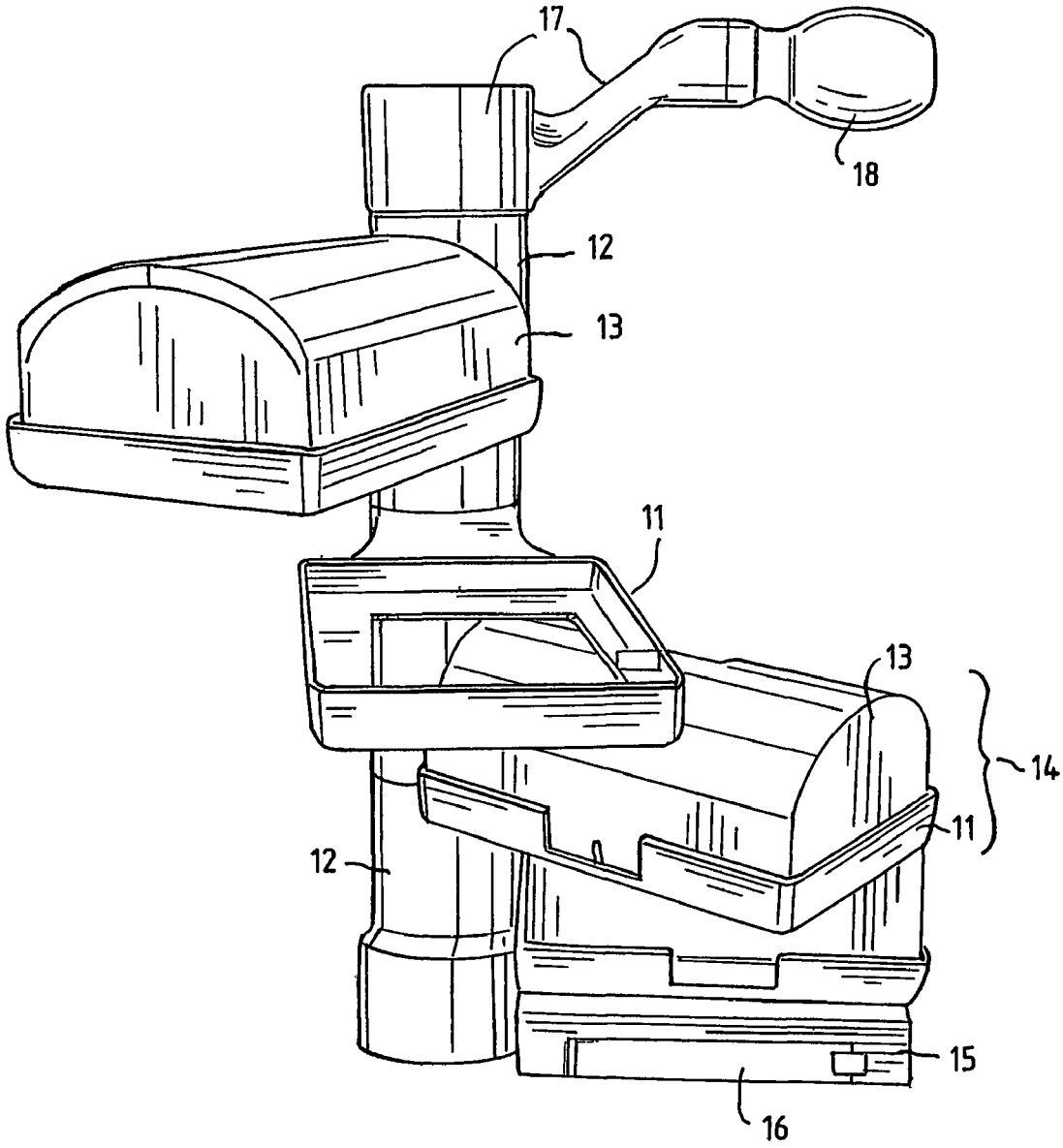
FIG. 6 illustrates the vertical tool storage device of this invention showing four trays.

FIG. 6 is similar to FIG. 1. It illustrates four trays (11) attached to the hollow upward pivot shaft (22) through coupling rings (12). This figure also illustrates a handle (18), the curved end cap (17), which is part of the handle (18), receptacle (13), container (14) and a swivel case (16) mounted in the bottom open chamber of the base (15).

Figure 7:
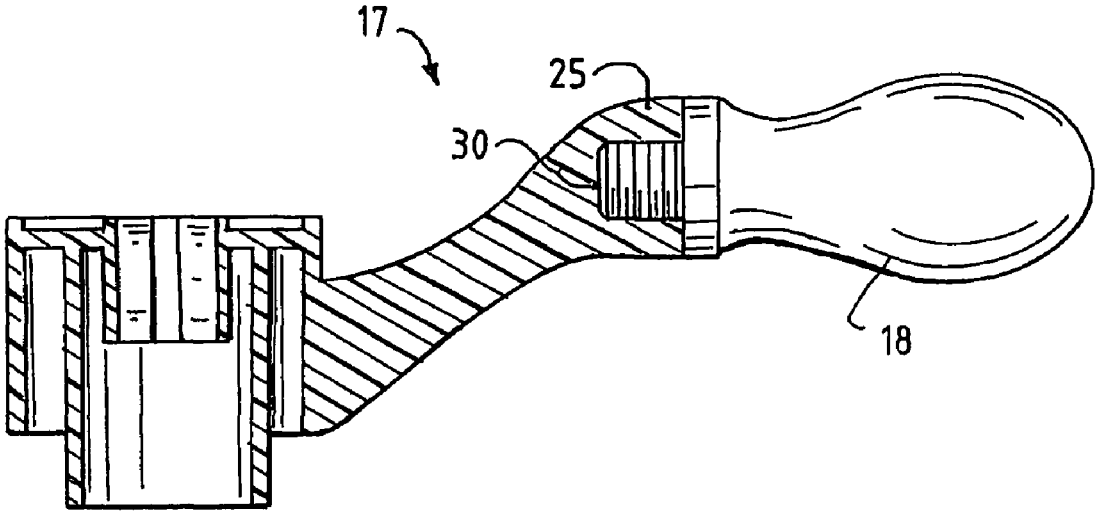
FIGS. 7 and 7A illustrate the curved detachable handle for holding a tool kit.
Figure 7A:
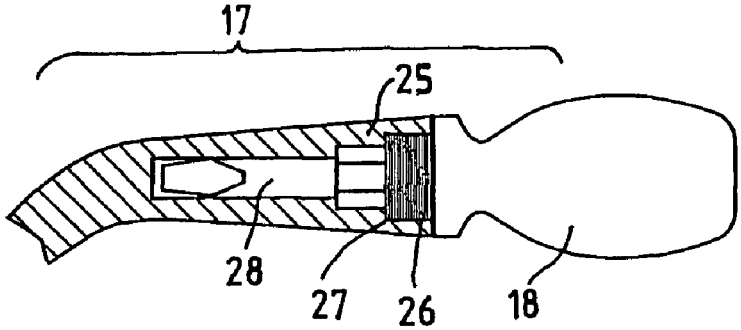

FIGS. 7 and 7A illustrate in detail the protruding handle (17) attached to the detachable handle (18) for holding a tool. A hollow shank (25) is shown. The tool bit (28), hand tool (30), inner thread (27), and threaded shoulder (26) are also illustrated.

Figure 8:
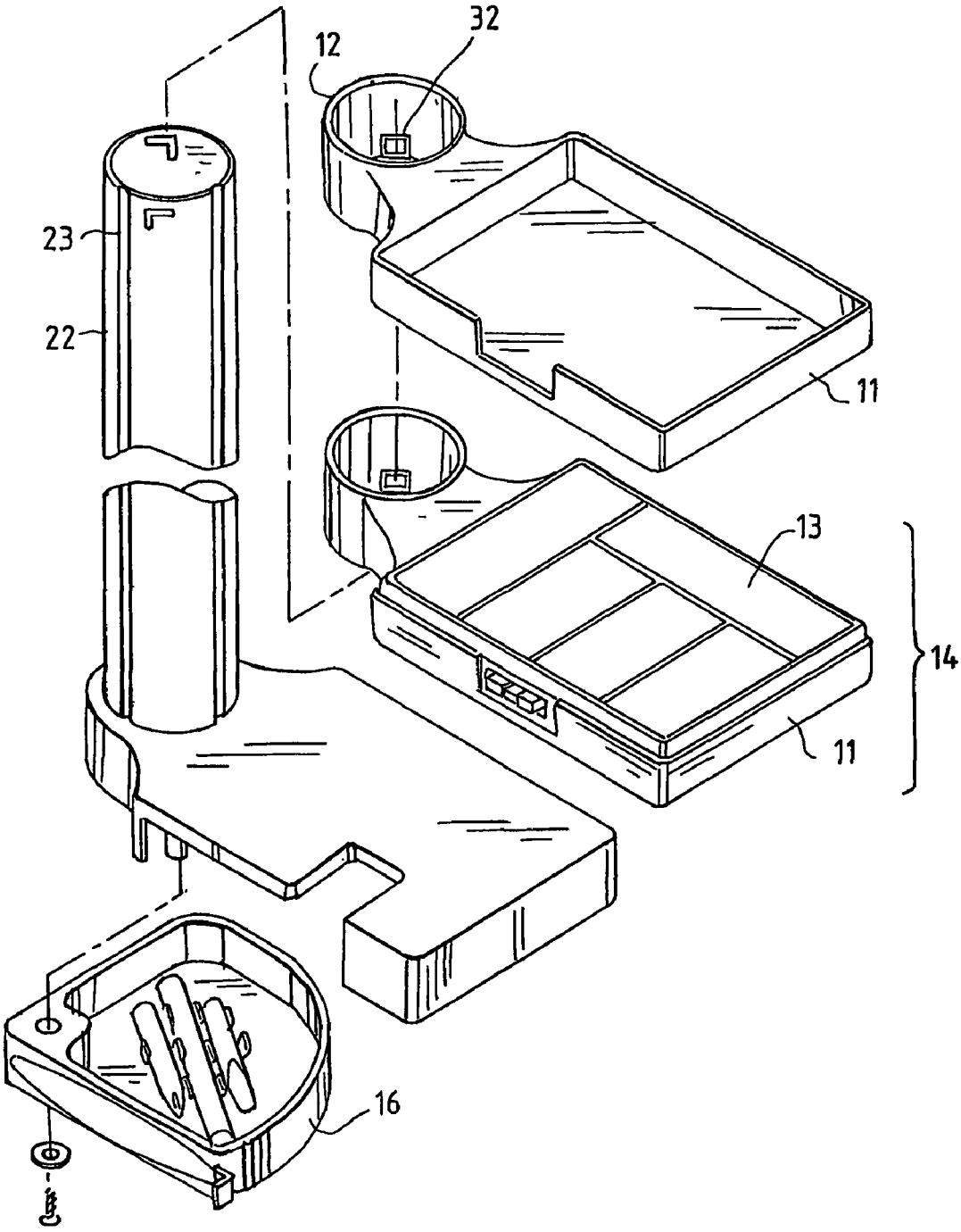
FIG. 8 illustrates in a disassembled manner the hollow upright pivot shaft, the equidistant grooves, trays, tool receptacle trays, tool container compartments, coupling rings, and spring strips. The figure illustrates how all parts cooperate to produce the vertical tool storage device.

FIG. 8 illustrates the mechanism how the container (14) through the coupling rings (12) attaches to the hollow upright pivot shaft (22) and the role of the three upright equidistant grooves (23) and the function of the retaining spring strips and spring projections (32) in the functioning of the tool storage device (10) of this invention. The trays (11) and receptacles (13) are also shown. A detailed swivel case (16) is also illustrated.

Figure 9:
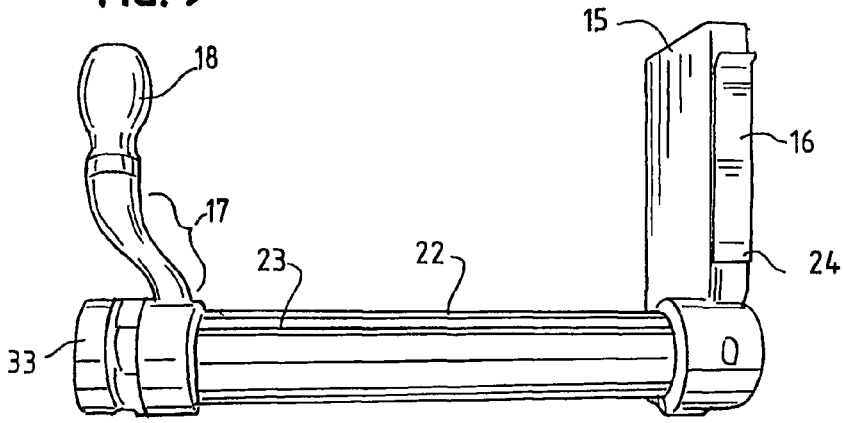
FIG. 9 illustrates the vertical tool storage device support without the container trays to show the hollow upright pivot shaft, with the end cap from whose side a partially curved handle extends to the detachable handle. Also shown is the base, the swivel case mounted in the bottom open chamber of the base.

FIG. 9 illustrates the inventive vertical tool storage device without the container (14) and the coupling rings (12), showing the vertical basic hollow upright pivot shaft (22) with the end cap (17) with the curved handle extending to the detachable handle (18). On top of the end cap (17) is a connecting structure (33). Also shown is the base (15), a bottom of the base (24), and swivel case (16) mounted in the bottom open chamber of the base (24).

Figure 10:
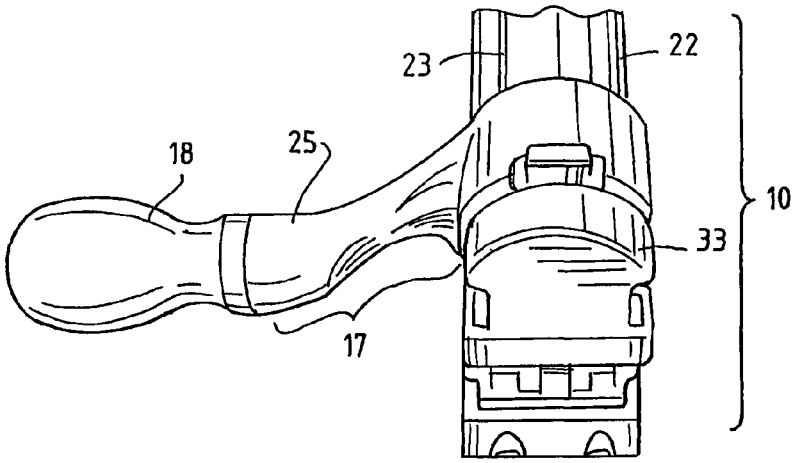
FIG. 10 illustrates in detail the top part of the vertical tool storage device including the curved end cap, hand tool, connecting structures, hollow upright pivot shaft, and equidistant grooves.

FIG. 10 shows in detail the top portion of the inventive vertical tool storage device (10). At the very top is shown a connecting structure (33) and the end cap (17) with a curved handle extending from the end cap to the detachable handle (18) including the hollow shank (25) of the curved handle (17), which is part of the end cap (17). Also shown is a section of the hollow upright pivot shaft (22) with a groove (23).

Figure 11:
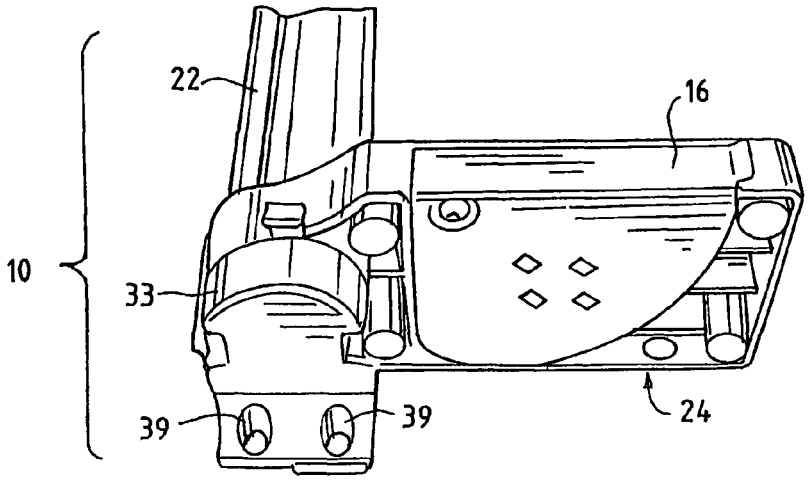
FIG. 11 illustrates the bottom part of the vertical tool storage device including the bottom of the base, swivel case, and connecting and fastening structure.

FIG. 11 shows in detail the bottom portion of the vertical tool storage device (10). Included are illustrations of the bottom of the base (24), swivel case (16), connecting structure (33). As shown, the vertical tool storage device can be connected to a wall or other support by passing screws or other connectors through the apertures (39). The hollow upright pivot shaft (22) is also shown.

Figure 12:
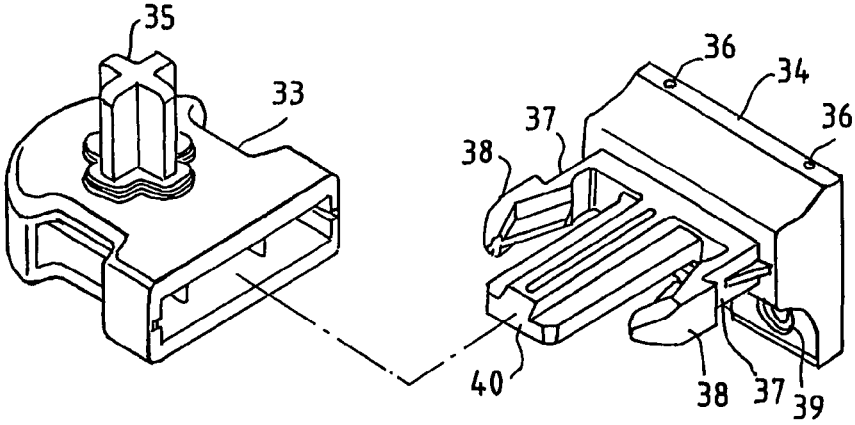
FIG. 12 illustrates the connecting and fastening structure, plug rod, spring locking bars and front guide face of the spring locking bar in a form not yet assembled.

FIG. 12 illustrates in detail the connecting structure (33) and the fastening structure (34), before they are assembled together. The connecting structure (33) has a plug rod (35), which conveniently can engage the plughole (20) located in the end cap (17). The plug rod (35) also can connect through the plughole (20) of the pole cover (21) at the bottom of the base (24) of the tool storage device (10). The fastening structure (34) shows apertures (36) for optionally connecting wires (41). Also shown are spring locking bars (37), front guide face of the spring locking bars (38), and apertures (39) for connecting the tool storage device (10) to the wall.

Figure 13:
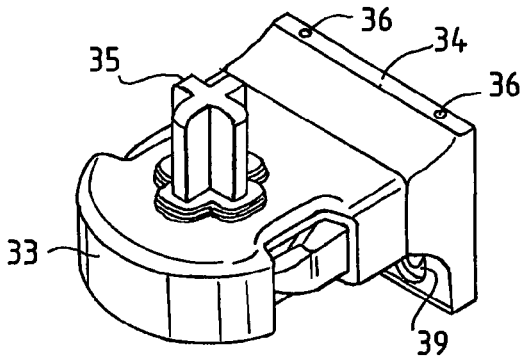
FIG. 13 is similar to FIG. 12, except that the connecting and fastening structure parts have been joined.

FIG. 13 illustrates the connecting structure (33) with the fastening structure (34), showing the plug rod (35), apertures (36) for optionally connecting wires (41), and apertures (39) for connecting the vertical tool storage device (10) to a wall or other support.

Figure 14:
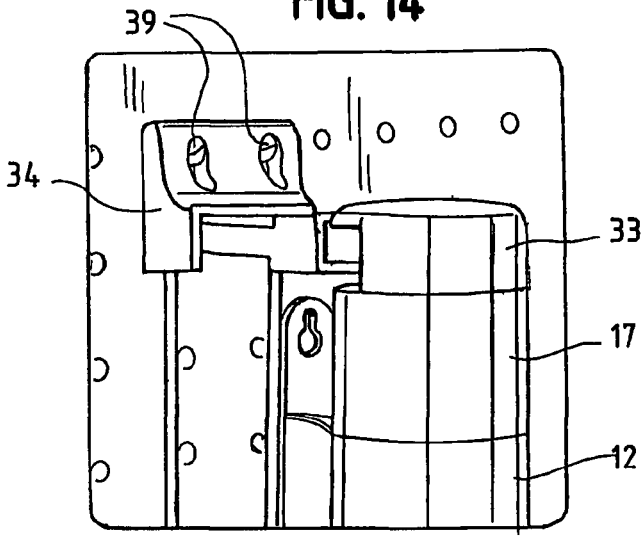
FIG. 14 illustrates the situation where the tool storage device has been hung on a wall.

FIG. 14 shows the vertical tool storage device (10) of this invention attached to a wall. Through apertures (39), screws connect a fastening structure (34) to the wall. The fastening structure (34) is connected to the connecting structure (33), which is connected to the end cap (17) having the protruding arm (17). Coupling rings (12) for trays (11) are also shown. Thus, the whole assembly of the vertical tool storage device (10) is attached to the wall.

Figure 15:
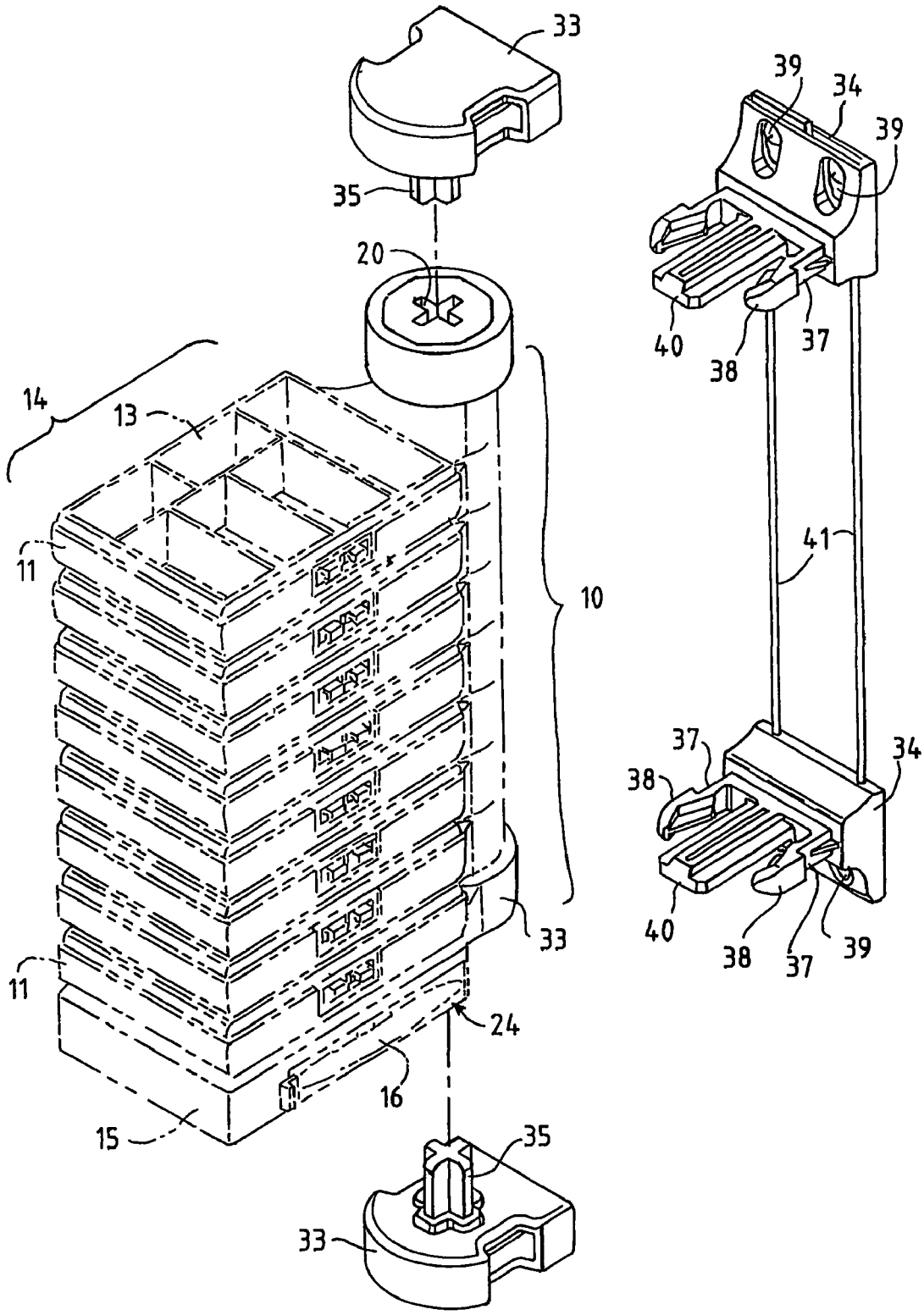
FIG. 15 illustrates one embodiment of the vertical tool storage device. The partially curved handle is not shown. The figure illustrates receptacle compartments, trays, and container support. The container support is sleeved to the pivot shaft through coupling rings, which are a part of the tray support. The role of the connecting and fastening structure is also shown. The container device includes the receptacle compartments, the tray support, and coupling rings.

FIG. 15 shows the vertical tool storage device (10) without the handle (18), tray (11), coupling rings (12), receptacle (13), and tool container (14). The tool container (14) comprises a tray (11), coupling rings (12), and a tool receptacle (13). Also shown are a plughole (20), a base (15), and a swivel case (16) mounted on the bottom open chamber (24). Furthermore, the following are illustrated: connecting structure (33) fastening structure (34), spring locking bar (37), front guide face of the spring locking bar (38), apertures (39) for connecting the tool storage device (10) to a wall via screws or equivalent means. There is also provided a center guide shaft (40) and optional wires (41) for holding the vertical storage device (10).

Various modifications to the invention are contemplated. It is understood, therefore, that within the scope of the appended claims, the invention may be practiced otherwise than specifically described.

What is claimed is:

1. A vertical tool storage device comprising:

(a) a base having a top side and a bottom side;

(b) a hollow upright pivot shaft having two ends, a top end and a bottom end;

(c) an end cap having a plughole on the top side of the end cap, the end cap being connectably attached to the top end of the hollow upright pivot shaft;

(d) the bottom end of the hollow upright pivot shaft attached to the top side of the base;

(e) the bottom side of the base having a pole cover containing a plughole for receiving a connecting structure;

(f) a plurality of tool containers respectively pivoted to the hollow upright pivot shaft and arranged in a stack, each tool container comprising a coupling ring with a tray attached and a tool receptacle residing in the tray;

(g) a tool container positioning structure provided in the coupling rings of said tool container wherein each coupling ring is sleeved onto said hollow upright pivot shaft;

(h) a partially curved handle as a projecting arm of the end cap, wherein the plug hole is formed at a location other than an end of the handle projecting arm, and (i) wherein, on top of the end cap through the plughole is attached a second end cap, which has a plughole on a top side.

2. The vertical tool storage device of claim 1, wherein the partially curved handle protruding from a side of the end cap has a distal end for receiving a hand tool inserted into the distal end of said partially curved handle.

3. The vertical tool storage device of claim 1, wherein the partially curved handle is strengthened by the addition of a rib.

4. The vertical tool storage device of claim 1, further comprising a plurality of longitudinal grooves spaced around the periphery of said hollow upright pivot shaft, and wherein the tool container positioning structures include a plurality of spring strips respectively formed integral with the coupling rings of said tool containers, said spring strips each comprising a projection adapted for engaging said longitudinal grooves.

5. The vertical tool storage device of claim 1, wherein the tool receptacle of each of said tool container is comprised of a bottom shell defining a plurality of compartments for keeping storage items, a top cover hinged to one side of said bottom shell and adapted for closing said compartments, and a snap fastener installed in said bottom shell and said top cover, said fastener adapted for locking said top cover when said top cover is closed on said bottom shell.

6. The vertical tool storage device of claim 5, wherein the tray of each of said tool container has an opening in the side wall corresponding to the snap fastener.

7. The vertical tool storage device of claim 3, wherein said hand tool comprises a handle and a threaded shoulder disposed at one end of the handle of said hand tool and adapted for detachably holding a tool bit and threading into a hollow shank.

8. The vertical tool storage device of claim 1, wherein said base comprises a bottom open chamber, and a swivel case mounted in said bottom open chamber.

9. The vertical tool storage device of claim 8, further comprising a pivoting structure provided between said bottom open chamber of said base and said swivel case for enabling said swivel case to be turned in and out of said bottom open chamber, and a swivel case positioning structure for enabling said swivel case to be positioned inside said bottom open chamber of said base.

10. The vertical tool storage device of claim 9, wherein said pivoting structure comprises a downward pivot rod suspended inside said bottom open chamber of said base, and a pivot aperture formed in one end of said swivel case and coupled to said downward pivot rod.

11. The vertical tool storage device of claim 10, wherein said pivoting structure further comprises a fastening structure fastened to said downward pivot rod to secure said swivel case to said downward pivot rod and to let said swivel case be turned in and out of said bottom open chamber of said base about said pivot rod.

12. The vertical tool storage device of claim 9, wherein said swivel case positioning structure comprises a first locating rib protruded from the periphery of said swivel case, and a second locating rib formed integral with an inside wall of said base inside said bottom open chamber and adapted for stopping said first locating rib by friction resistance to hold said swivel case inside said bottom open chamber of said base.

13. The vertical tool storage device of claim 8, wherein said swivel case comprises a plurality of clamps adapted for holding tool bits or other supplies inside said swivel case.

14. The vertical tool storage device of claim 1 wherein between four and eight tool containers are respectively pivoted to the hollow upright pivot shaft.

15. A vertical tool storage device comprising:

(a) a base having a top side and a bottom side;

(b) a hollow upright pivot shaft having two ends, a top end and a bottom end;

(c) a first end cap having a plughole on a top side of the first end cap, the first end cap being connectably attached to the top end of the hollow upright pivot shaft;

(d) the bottom end of the hollow upright pivot shaft attached to the top side of the base;

(e) the bottom side of the base having a pole cover, containing a plughole for receiving a connecting structure;

(f) a plurality of tool containers respectively pivoted to the hollow upright pivot shaft and arranged in a stack, each tool container comprising a coupling ring with a tray attached and a tool receptacle residing in the tray;

(g) the first end cap having a coupling wall, the plughole being formed in the coupling wall;

(h) the pole cover having a coupling wall, the plughole being formed in the coupling wall;

(i) a first detachable connecting structure having a plug rod attached to the first end cap;

(j) a second detachable connecting structure having a plug rod attached to the pole cover, (k) a plurality of fastening structures comprising a mounting base having a plurality of apertures for fastening to an upright support structure;

(l) each fastening structure comprising a coupling unit detachably connectable to the connecting structure;

(m) a tool container positioning structure provided in the coupling rings of said plurality of tool containers and the hollow upright pivot shaft for enabling each of said tool containers to be horizontally turned about said hollow upright pivot shaft and positioned in one of a series of angular positions;

(n) a partially curved handle protruding from the side of the first end cap, wherein the plug hole is formed at a location other than and end of the curved handle; and (o) a second end cap, mounted to the plughole on the top side of the first end cap, the second end cap having a plug hole on a top side thereof.

16. The vertical tool storage device of claim 15, wherein between four and eight tool containers are respectively pivoted to the hollow upright pivot shaft.

17. The vertical tool storage device of claim 15, wherein the partially curved handle protruding from a side of the end cap has a distal end for receiving a hand tool inserted into the distal end of said partially curved handle.

18. The vertical tool storage device of claim 17, wherein the partially curved handle is strengthened by the addition of a rib.

19. The vertical tool storage device of claim 15, wherein said tool container positioning structure includes a plurality of longitudinal grooves spaced around the periphery of said hollow upright pivot shaft, and a plurality of spring strips respectively formed integrally with the coupling rings of said tool container, said spring strips each comprising a projection adapted for engaging said longitudinal grooves.

20. The vertical tool storage device of claim 15, wherein the tool receptacle of each of said tool container is comprised of a bottom shell defining a plurality of compartments for keeping storage items, a top cover hinged to one side of said bottom shell and adapted for closing said compartments, and a snap fastener installed in said bottom shell and said top cover, said fastener adapted for locking said top cover when said top cover is closed on said bottom shell.

21. The vertical tool storage device of claim 20, wherein the tray of each of said tool container has an opening in the sidewall thereof corresponding to the snap fastener.

22. The vertical tool storage device of claim 17, wherein said hand tool comprises a handle and a threaded shoulder disposed at one end of the handle of said hand tool and adapted for detachably holding a tool bit and threading into a hollow shank.

23. The vertical tool storage device of claim 15, wherein said base comprises a bottom open chamber, and a swivel case mounted in said bottom open chamber.

24. The vertical tool storage device of claim 23, further comprising a pivoting structure provided between said bottom open chamber of said base and said swivel case for enabling said swivel case to be turned in and out of said bottom open chamber, and a swivel case positioning structure for enabling said swivel case to be positioned inside said bottom open chamber of said base.

25. The vertical tool storage device of claim 24, wherein said pivoting structure comprises a downward pivot rod suspended inside said bottom open chamber of said base, and a pivot aperture formed in one end of said swivel case and coupled to said downward pivot rod.

26. The vertical tool storage device of claim 24, wherein said swivel case positioning structure comprises a first locating rib protruded from the periphery of said swivel case, and a second locating rib formed integral with an inside wall of said base inside said bottom open chamber and adapted for stopping said first locating rib by friction resistance to hold said swivel case inside said bottom open chamber of said base.

27. The vertical tool storage device of claim 23, wherein said swivel case comprises a plurality of clamps adapted for holding tool bits inside said swivel case.

* * * * *